US010099892B2

(12) United States Patent
Suihkonen et al.

(10) Patent No.: US 10,099,892 B2
(45) Date of Patent: Oct. 16, 2018

(54) ELEVATOR GROUP CONTROLLER WITH WEAR BASED CALL ALLOCATION OF ELEVATORS

(71) Applicant: KONE Corporation, Helsinki (FI)

(72) Inventors: Kari Suihkonen, Hyvinkää (FI); Marja-Liisa Siikonen, Helsinki (FI); Harri Hakala, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 421 days.

(21) Appl. No.: 14/956,124

(22) Filed: Dec. 1, 2015

(65) Prior Publication Data

US 2016/0090269 A1 Mar. 31, 2016

Related U.S. Application Data

(63) Continuation of application No. PCT/FI2013/050730, filed on Jul. 3, 2013.

(51) Int. Cl.
*B66B 1/18* (2006.01)
*B66B 1/24* (2006.01)

(52) U.S. Cl.
CPC ..... *B66B 1/2458* (2013.01); *B66B 2201/22* (2013.01)

(58) Field of Classification Search
CPC ..... B66B 1/2458; B66B 2201/22
USPC ..... 187/247, 380–389, 391, 393
See application file for complete search history.

(56) References Cited

U.S. PATENT DOCUMENTS

| | | | | |
|---|---|---|---|---|
| 4,149,613 | A | 4/1979 | Yoneda et al. | |
| 4,323,142 | A | 4/1982 | Bittar | |
| 4,458,787 | A * | 7/1984 | Uetani | B66B 1/2458 187/387 |
| 4,512,442 | A | 4/1985 | Moore et al. | |
| 4,750,591 | A * | 6/1988 | Coste | B66B 5/0006 187/391 |
| 4,930,604 | A * | 6/1990 | Schienda | B66B 5/0006 187/393 |
| 6,330,935 | B1 | 12/2001 | Systermans | |
| 6,516,923 | B2 * | 2/2003 | Lence Barreiro | B66B 13/22 187/247 |

(Continued)

FOREIGN PATENT DOCUMENTS

| | | |
|---|---|---|
| CN | 103121609 A | 5/2013 |
| EP | 2 341 027 A1 | 7/2011 |

(Continued)

*Primary Examiner* — Anthony Salata
(74) *Attorney, Agent, or Firm* — Birch, Stewart, Kolasch & Birch, LLP

(57) ABSTRACT

The invention improves control of wear and tear of the elevators in an elevator group having a plurality of elevators and at least one group control unit. The actual usage of each elevator is recorded, and the group control unit executes at least one allocation algorithm for selecting which elevator of the elevator group is used to serve a call. The allocation algorithm compares the actual usage of at least two elevators against respective target usages and selects the elevator having its actual usage most deviating from the target usage to serve an outstanding call. With the invention, the wear and tear of elevators may be balanced, or certain elevators may be set to reach the end of the maintenance period sooner.

15 Claims, 1 Drawing Sheet

(56) References Cited

U.S. PATENT DOCUMENTS

| | | | | |
|---|---|---|---|---|
| 6,543,583 | B1 * | 4/2003 | Lence Barreiro | B66B 5/0025 187/316 |
| 6,976,560 | B2 * | 12/2005 | Newby | B66B 1/2458 187/247 |
| 7,004,289 | B2 * | 2/2006 | Shrum, III | B66B 5/0037 187/393 |
| 7,370,732 | B2 * | 5/2008 | Richter | B66B 5/0025 187/380 |
| 7,975,808 | B2 * | 7/2011 | Smith | B66B 1/2458 187/247 |
| 8,544,612 | B2 * | 10/2013 | Korhonen | B66B 1/468 187/387 |
| 2012/0325589 | A1 | 12/2012 | Christy et al. | |
| 2015/0329316 | A1 * | 11/2015 | Lee | B66B 1/2458 187/384 |

FOREIGN PATENT DOCUMENTS

| | | | |
|---|---|---|---|
| JP | 5-162930 | A | 6/1993 |
| JP | 2001-80830 | A | 3/2001 |

* cited by examiner

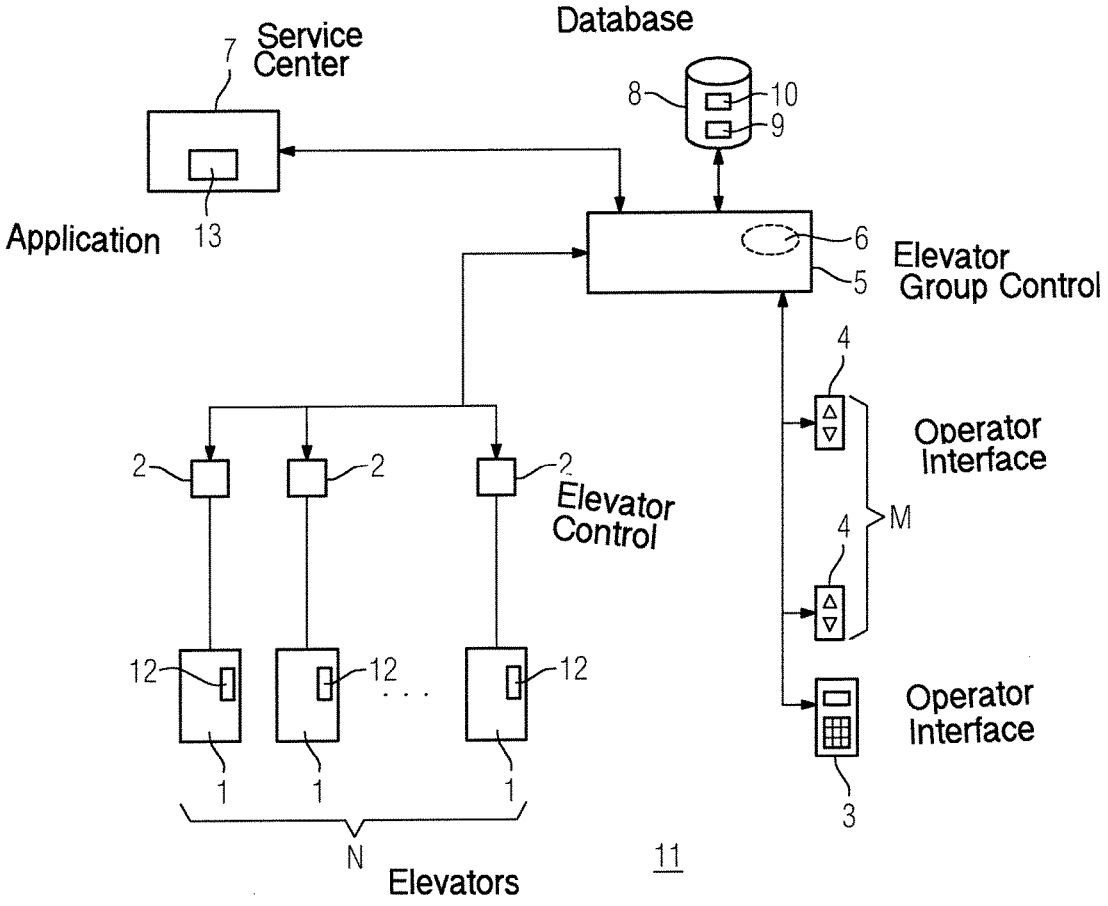
Service Center
7
Database
8
10
9
Application
13
6
5
Elevator Group Control
4
Operator Interface
M
2
2
2
Elevator Control
4
12
12
12
Operator Interface
1
1
1
3
N
Elevators
11

ELEVATOR GROUP CONTROLLER WITH WEAR BASED CALL ALLOCATION OF ELEVATORS

CROSS REFERENCE TO RELATED APPLICATIONS

This application is a Continuation of PCT International Application No. PCT/FI2013/050730 filed on Jul. 3, 2013, which is hereby expressly incorporated by reference into the present application.

FIELD OF THE INVENTION

The invention relates to control of elevator groups comprising a plurality of elevators.

TECHNICAL BACKGROUND

In a typical elevator group comprising a plurality of elevators, elevator calls are allocated to individual elevators by the elevator group control unit by using an allocation algorithm.

The allocation algorithm tries to optimize the operation of the elevator system by minimizing certain cost factors. An example of an allocation algorithm is disclosed in published patent application WO 01/65231 A2.

In certain situations it may happen that two or more elevators would be equally well or almost equally well in view of the allocation algorithm.

In such cases, the elevator group control unit normally selects the elevator that is used to serve the call by using a straightforward method. Normally, the elevator with the smallest order number in the elevator group is selected. In an exemplary situation, if elevators B and C are waiting in the $2^{nd}$ floor and the passenger gives a call in the $1^{st}$ floor, the elevator B will always be selected, even though elevator C would be as good or almost as good as the elevator B.

In modern elevator groups, one or more elevators may be returned to the floor in which peak traffic time passengers are waiting or are supposed to be waiting. Generally, such peak traffic is experienced in office buildings in the morning (people coming to work) in the floor with entrance(s) to the building, and during lunch break in the floor(s) with restaurant facilities. In certain mode(s) of operation, therefore, the allocation algorithm in the elevator group control unit selects the elevator with the smallest order number in the elevator group.

Such operation mode may be activated also outside peak traffic times.

SUMMARY OF THE INVENTION

One consequence resulting from the use of a selection algorithm of the kind mentioned above in the elevator group control unit is that the elevator having the smallest order number will be used much more than the other elevators in the elevator group.

This increases the wear and tear in such elevators, which typically causes the elevator sooner or later to fail. In addition, wear and tear also increases the need for maintenance for such elevators.

It is an objective of the invention to improve the control of wear and tear of the elevators in an elevator group.

This objective can be achieved with the first aspect of the invention which is the method according to independent claim 1, with the second aspect of the invention which is the elevator group control unit according to parallel independent claim 8, and with the third aspect of the invention which is the elevator group according to parallel independent claim 10.

The dependent claims describe various advantageous facets of the method and the elevator group control unit.

A further objective of the invention is to simplify the controlling of wear and tear of the elevators in an elevator group. This objective can be achieved with the fourth aspect of the invention which is the application according to parallel independent claim 11.

Advantages of the Invention

In the method for allocating calls in an elevator group comprising a plurality of elevators and at least one group control unit, the actual usage of each elevator is recorded. The group control unit executes at least one allocation algorithm for selecting which elevator of the elevator group is used to serve a call. The allocation algorithm is configured to compare the actual usage of at least two elevators against respective target usages and to select the elevator having its actual usage most deviating from the target usage to serve an outstanding call. In this manner, the wear and tear of elevators in the elevator group can be controlled based on the actual usage and target usage.

Most preferably, the at least two elevators, the actual usage of which is compared against respective target usages, are chosen from the group of elevators having an equal cost or having a cost below a pre-defined threshold, as determined by the allocation algorithm. This enables fine-tuning of the existing allocation algorithms. Also, since the other cost factors such as traveling distance, traveling time, or energy cost, can be taken into account by the allocation algorithm, the elevator group will most preferably not be driven based on actual/target usage considerations only but that the actual/target usage considerations are used to refine the selection algorithm.

The actual usage of an elevator may be obtained as a function of the actual number of calls served by the elevator, share of calls served by the elevator from the calls served by the elevator group, distance travelled by the elevator, and/or share of distance travelled by the elevator from the distance travelled by the elevators in the elevator group. The simplest way is to record the number of starts (i.e. number of calls served). Alternatively, or in addition, the distance travelled can be recorded or computed.

The target usage may be computed for each elevator by multiplying the number of calls served by the elevator group or the distance travelled by the elevators in the elevator group with a target share of each elevator. This is a particularly simple manner for obtaining the target usage.

The target usage may be balanced between the elevators, for evening out wear and tear among the elevators. If the wear and tear among the elevators is evened out, all elevators may be serviced during one maintenance visit. In this manner, the failure of elevator(s) used most actively before the maintenance visit can be better avoided.

Alternatively, the target usage may be set higher for a subgroup of elevators than for the rest of the elevators in the elevator group, for the elevator or elevators in the subgroup reaching the end of maintenance period sooner. This is particularly advantageous for the following reasons: There exists a certain category of larger maintenance operations (elevator modernization, changing of elevator hoisting, for example) during which an elevator will be out of service for a longer period of time. In such cases it is advantageous if the maintenance operations do not need to be carried out at all elevators at the same time. It is advantageously if they can be scheduled for each elevator individually. In such a situation, evening out the wear and tear would clearly not be the optimal choice since it were more advantageous to drive certain elevators more in order to have them reaching the end of the respective maintenance intervals earlier than the other elevators in the elevator group. It may be desirable to carry out the maintenance at a pre-scheduled time, so that the maintenance operations and the maintenance time may need to be forecasted in good time.

The target usage may be computed based on a target profile for each elevator. In particular, if there is a profile for usage or wear and tear of elevators in the elevator group, with different profiles we can follow different objectives, such as balancing the wear and tear between elevators (for maintenance of a plurality of elevators at one time), or having certain elevator(s) to wear out earlier (for their maintenance earlier or at a specific time, such as for modernisation).

The elevator group control unit according to the second aspect of the invention is configured to carry out the method according to the first aspect of the invention. The elevator group control unit can be used to improve the control of wear and tear of the elevators in an elevator group.

The group control unit may be connected to a data base for recording information of actual usage and/or target usage. The use of a data base may facilitate handling of large number of use data.

The elevator group according to the third aspect of the invention comprises a number of elevators and elevator controls and at least one elevator group control unit according to the second aspect of the invention. The elevator group control unit is configured to collect usage information from car operator panels, up buttons and down buttons, and/or destination operating panel. The elevator group control unit is also configured to command the elevator chosen by the allocation algorithm to serve an outstanding call. The elevator group can be used to improve the control of wear and tear of the elevators in the elevator group.

The application according to the fourth aspect of the invention is executable in a remote service centre or in the elevator group control unit according to the second aspect of the invention. The application is configured to: a) remotely read usage data and/or target usage from an elevator group control unit and/or data base of the elevator group; and/or b) set the target usage and/or target profile for certain elevators or all elevators in the elevator group. With the application, controlling of wear and tear of the elevators in the elevator can be simplified since it can be automated or even performed remotely.

BRIEF DESCRIPTION OF THE DRAWSING

The drawings schematically illustrate the elevator system 11 of the present application.

DETAILED DESCRIPTION

An exemplary embodiment shown in the sole drawing is explained below in more detail.

The drawing shows an elevator system 11 in which the method according to the invention can be applied. The elevator system 11 comprises N elevators 1 (N=2, 3, 4, . . . ), each elevator 1 controlled by its own elevator control 2 as required control commands.

The drawing illustrates a ground floor and M (M=1, 2, 3, . . . ) upper floors. Each floor has at least one operator interface. In the ground floor the operator interface 3 generally is the destination operating panel (DOP). In the upper floors, the operator interface 4 generally comprises the down button and the up button. Furthermore, the elevator car has an operator interface 12 that generally is designated as car operating panel (COP), for giving elevator 1 commands in the elevator car.

The allocation algorithm 6 operates in elevator group control unit 5 and gives the drive commands to elevators 1. Even though the drawing shows one elevator group control unit 5 only, there may be more than one such units especially if the elevator group 11 comprises a very large number of elevators 1. There may also be more than one allocation algorithms 6 in each elevator group control unit 5.

The distance travelled (mileage) is stored in database 8 in group control. Database 8 comprises number of starts for each elevator 1, and/or total mileage for each elevator 1.

The distribution algorithm 6 receives as its input manually generated calls given by passengers via operator interfaces 3, 4 on floors (DOP, up buttons and down buttons), and calls automatically generated at elevator group control unit 5.

Such automatically generated calls may include calls for returning one or more elevators 1 to a given floor, such as may be required in peak traffic time detected, which the elevator group control unit 5 may detect on basis of passengers' waiting times getting longer, etc. Several ways exist for detecting whether traffic has increased to peak traffic.

Elevators 1 perform rides based on calls given via the operator interfaces 12 in the elevator cars i.e. via the COP. The elevator group control unit 5 and allocation algorithm 6 do not take these calls into account. However, these calls are preferably stored in database 10 as usage data 9, similarly to the calls generated via operator interfaces 3, 4 and to the calls automatically generated by the elevator group control unit(s) 5.

When the allocation algorithm 6 receives an outstanding call, it allocates an elevator 1 in the elevator group 11 that best matches with the given optimization criteria. As optimization criteria waiting time, energy required etc. may be used. The optimization criteria most preferably reflect the actual distance (usage data 9) travelled (mileage) by an elevator 1 by comparing it against a target usage 10. The more the actual distance travelled is below the target distance travelled for a particular elevator 1, the larger the weighting factor the elevator 1 will be used in the allocation algorithm 6.

Example

Let us consider a situation where the elevator system 11 comprises two elevators 1 (say, elevators A and B), and it is required that the distance travelled will be balanced between the elevators A and B. In such a situation, the target distance travelled should be 50% for A and 50% for B. Now, if the actual distance travelled by A is 40% and the actual distance travelled by B is 60%, elevator A shall be favoured in the allocation algorithm 6, according to the optimization criteria.

However, if it were required that the actual distance travelled is not in balance, say A should travel 30% and B should travel 70%, the elevator car B would be favoured. In the long run, the actual distance travelled will reach the target profile for distance travelled.

In the drawing also a remote service centre 7 is shown. An option is to provide the elevator group 11 or the service centre 7 with application 13 that remotely reads the actual usage data 9 and/or sets the target usage 10 (or the target profiles).

The distance travelled may be computed cumulatively since the installation of the elevator. Alternatively or in addition, the counters for distance travelled may be reset at maintenance or service, for example, so that after the service or maintenance, a new observation period starts.

It is not necessary that the elevator system 11 is a hybrid elevator system as shown in the drawing. In particular, the elevator system 11 may be a destination controlled elevator system or a traditional elevator system with up and down buttons.

It is possible to use genetic algorithms to allocate the calls.

In other words, in call allocation during eight o'clock traffic, for example, the vacant elevator 1 having the least number of starts during the last month or months according to the statistics (usage data 9 in data base 10, for example) may be selected to serve a new call. In this manner, the wear of elevators 1 can be balanced.

In still other words, the control system for elevator group 11 may be designed in such a manner that it allocates distance travelled according to a desired profile. For example so that always one of the elevators 1 will reach the end of a service interval at a time. In this manner, the need for service can be planned better and the situation in which all elevators 1 would need service at the same time can be avoided.

The invention is not to be understood to be limited in the attached patent claims but must be understood to encompass all their legal equivalents.

The invention claimed is:

1. A method for allocating calls in an elevator group comprising a plurality of elevators and at least one group control unit, wherein:

the actual usage of each elevator is recorded;

the group control unit executes at least one allocation algorithm for selecting which elevator of the elevator group is used to serve a call;

the allocation algorithm is configured to compare the actual usage of at least two elevators against respective target usages and to select the elevator having its actual usage most deviating from the target usage to serve an outstanding call.

2. A method according to claim 1, wherein: the at least two elevators, the actual usage of which is compared against respective target usages, are chosen from the group of elevators having an equal cost or having a cost below a pre-defined threshold, as determined by the allocation algorithm.

3. A method according to any one of claim 1 or 2, wherein: the actual usage of an elevator is obtained as a function of the actual number of calls served by the elevator, share of calls served by the elevator from the calls served by the elevator group, distance travelled by the elevator, and/or share of distance travelled by the elevator from the distance travelled by the elevators in the elevator group.

4. A method according to claim 1, wherein: the target usage is computed for each elevator by multiplying the number of calls served by the elevator group or the distance travelled by the elevators in the elevator group with a target share of each elevator.

5. A method according to claim 1, wherein: the target usage is balanced between the elevators, for evening out wear and tear among the elevators.

6. A method according to claim 1, wherein: the target usage is set higher for a subgroup of elevators than for the rest of the elevators in the elevator group, for the elevator or elevators in the subgroup reaching the end of maintenance period sooner.

7. A method according to claim 1, wherein: the target usage is computed based on a target profile for each elevator.

8. An elevator group control unit, wherein: the elevator group control unit is configured to carry out the method of claim 1.

9. Elevator group control unit according to claim 8, wherein: the group control unit is connected to a data base for recording information of actual usage and/or target usage.

10. Elevator group, wherein: the elevator group comprises a number of elevators and elevator controls and at least one elevator group control unit according to any one of claim 8 or 9, wherein: the elevator group control unit is configured to collect usage information from car operator panels, up buttons and down buttons, and/or destination operating panel, wherein: the elevator group control unit is also configured to command the elevator chosen by the allocation algorithm to serve an outstanding call.

11. Application executable in a remote service centre or in the elevator group control unit according to claim 8 or 9, wherein: the application is configured to: a) remotely read usage data and/or target usage from an elevator group control unit and/or data base of the elevator group; and/or b) set the target usage and/or target profile for certain elevators or all elevators in the elevator group.

12. A method according to claim 2, wherein: the target usage is computed for each elevator by multiplying the number of calls served by the elevator group or the distance travelled by the elevators in the elevator group with a target share of each elevator.

13. A method according to claim 3, wherein: the target usage is computed for each elevator by multiplying the number of calls served by the elevator group or the distance travelled by the elevators in the elevator group with a target share of each elevator.

14. A method according to claim 2, wherein: the target usage is balanced between the elevators, for evening out wear and tear among the elevators.

15. A method according to claim 3, wherein: the target usage is balanced between the elevators, for evening out wear and tear among the elevators.

* * * * *